United States Patent [19]

Watanabe

[11] 4,134,147

[45] Jan. 9, 1979

[54] TRANSFER HUMIDITY CONTROL DEVICE

[75] Inventor: Toshio Watanabe, Ebina, Japan

[73] Assignee: Rank Xerox Limited, London, England

[21] Appl. No.: 832,032

[22] Filed: Sep. 9, 1977

[30] Foreign Application Priority Data

Nov. 2, 1976 [JP] Japan ..... 51-131209

[51] Int. Cl.[2] ..... H01T 19/00

[52] U.S. Cl. ..... 361/235; 355/3 CH; 355/3 TR; 355/14

[58] Field of Search ..... 361/178, 229, 235; 307/149; 355/3 CH, 3 TR, 14

[56] References Cited

U.S. PATENT DOCUMENTS 3,816,756 6/1974 Bresnick ..... 361/235 X

OTHER PUBLICATIONS

Eastman Kodak Research Disclosure, 1/75, pp. 16–17.

*Primary Examiner*—Harry E. Moose, Jr.

[57] ABSTRACT

In an electrostatographic copying system wherein an image on an initial image support is transferred to a copy sheet, particularly by a transfer corona generator assisted by an auxiliary transfer corona generator applying pre-transfer charges to the initial image support, opposing conductive rollers measure the conductivity of each copy sheet prior to transfer and through a control circuit vary the voltages applied to both the transfer corona generator and the auxiliary transfer corona generator means accordingly. A relay switching system is disclosed automatically selecting between AC and two levels of DC transfer voltages in response to four different copy sheet humidity conditions to optimize the image transfer.

13 Claims, 5 Drawing Figures

TRANSFER HUMIDITY CONTROL DEVICE

This invention relates to a transfer control system for image transfer in electrostatographic copying machines. It is of particular interest for copiers having a transfer corona generator for transferring powderized imaging material such as toner or the like to support media such as paper copy sheets and an auxiliary transfer corona generator for assisting that transfer.

In electrophotographic copying machines, for example, of the type wherein transfer of powderized material such as toner particles from a photosensitive body to a paper sheet is by a transfer corotron, the transfer process sometimes becomes ineffective when the moisture contents in the paper sheets comprising the image support media for the transfer exceed 7%. By using an appropriately powered auxiliary transfer corotron ahead of the transfer corotron, transfer may be enabled for such paper sheets with moisture contents of more than 7%, and even for metal sheets. In that case there may be an undesirable effect, however, on the quality of the transferred images if transfer is then performed on paper sheets with less than 5% moisture content.

It is, therefore, highly desirable to optimize the voltages applied to the transfer corotron and the auxiliary transfer corotron depending on the actual moisture contents and types of the paper copy sheets.

Moisture contents may be classified in four ranks as shown below for obtaining satisfactory image quality in the copy sheets. The moisture contents of each rank and exemplary optimum applied transfer voltages corresponding thereto are shown in the following table:

| RANK | MOISTURE CONTENT | TRANSFER COROTRON | AUXILIARY COROTRON |
|---|---|---|---|
| 1 | More than 8% | AC 5.5 KV | DC 3.5 KV |
| 2 | 5 - 8% | DC 6 KV (Normal) | AC 5 KV |
| 3 | 3 - 5% | DC 6 KV (Normal) | — |
| 4 | Less than 3% | DC 5.5 KV | — |

Conventionally, no means are available in a copier for automatic measurement of the moisture contents of the paper copy sheets. That undesirably necessitates manual changing of the transfer system voltage levels depending on the humidity conditions in which the machine is placed and/or changes in the ambient humidity conditions as with the seasons. In a conventional system, other serious difficulties are encountered as well. For instance, while the moisture content in a paper sheet may be as low as about 4% even in an atmosphere with more than 80% relative humidity just after the opening of the paper package, it can increase to more than 7% just with the lapse of time after the package is opened. Since the actual moisture content in paper sheets stored in a paper feed tray in a copying machine is thus undeterminable even if the ambient humidity is known, one or two trial runs are required if manual adjustments are to be made, which is not advantageous for a commercial copier.

The present invention provides a transfer control device capable of automatically controlling the complete transfer charge applying system automatically in response to the actual moisture contents that have developed in the copy sheets.

Considering some of the art in this technical area, a pending application Ser. No. 668,008, filed Mar. 18, 1976, to George H. Place, Jr., now U.S. Pat. No. 4,076,407 and the art cited therein is noted. That application teaches varying the detack or transfer corotron voltage levels in response to second side copying to partially compensate for respective humidity changes.

The art further includes U.S. Pat. No. 3,554,161, issued Jan. 12, 1971, to R. G. Blanchette on a system for controlling a developing corona generator in response to the conductivity of the paper base of a photoelectric recording member sensed by passing current through that base between conductive rollers.

U.S. Pat. No. 3,950,680, issued Apr. 13, 1976, to T. B. Michaels, et al., especially Cols. 10–11, is also of interest, as disclosing a transfer system in which the conductivity of the copy sheet during transfer changes the transfer corona generator output.

Other U.S. patents relating to humidity responsive transfer level controls include U.S. Pat. No. 3,837,741, issued Sept. 24, 1974, to P. R. Spencer, and U.S. Pat. No. 3,877,416, issued Apr. 15, 1975, to J. M. Donahue, et al..

This invention will now be further described by way of a preferred embodiment shown in the accompanying drawings.

BRIEF DESCRIPTION OF THE DRAWINGS

The drawings show a preferred embodiment of this invention wherein:

Referring to FIGS. 1–5, there is disclosed, in a transfer apparatus of an electrophotographic copying machine wherein powderized imaging material is transferred to support media by a transfer corotron 9 and auxiliary transfer corotron 8 for assisting transfer, a transfer control device comprising a measuring device for the measurement of moisture content in the support media to which the image is transferred and a transfer control circuit for switching the voltages to be applied to the transfer corotron 9 and auxiliary transfer corotron 8 depending on the measured moisture content.

As shown in FIG. 1, a paper copy sheet 2 is conventionally fed from a sheet feed tray 1 by sheet feed roller 3, through a sheet guide 4, to rubber sheet carrying rollers 5 and 6. There is also shown a conventional xerographic developing device 7, exposure slit 10, charging corotron 11, photosensitive drum 12, cleaning brush 13, cleaning corotron 14, copy sheet conveyor belt 15, and image fixing or fusing device 16.

As shown in FIG. 2, the sheet carrying rollers 5, and also a moisture detection or sensor roller 32', are all secured to a shaft 20 driven by pulley 19. The opposing sheet carrying rollers 6, and also an opposing detection roller 32 are secured to an opposing shaft 21 so that the sheet carrying rollers 5 and 6 and the detection rollers 32 and 32', respectively tightly contact or nip one another with desired pressures provided by springs 23 and 23' between the two shafts 20 and 21. The sensing rollers 32 and 32' rotatably engage directly opposite areas of opposite sides of the centers of each copy sheet as each copy sheet moves therebetween into the transfer area, which is immediately downstream therefrom.

Figure 2:
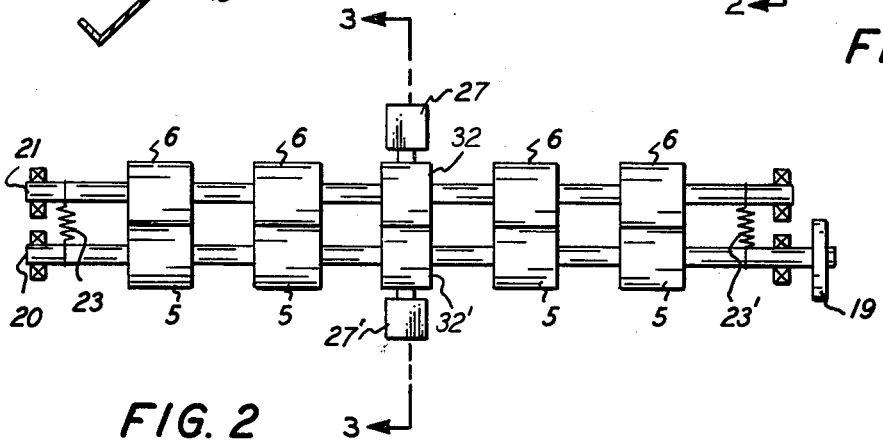
FIG. 2 is an enlarged view taken along the line 2—2 in FIG. 1 showing the moisture content sensor.
Figure 3:
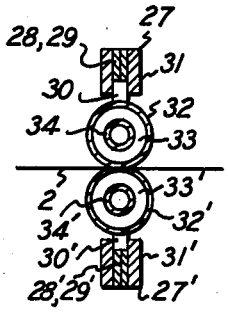
FIG. 3 is a cross-sectional view taken along the line 3—3 in FIG. 2.

The structures of these detection rollers 32 and 32' are shown in detail in FIG. 3. They include carbon brush devices 30, 30', springs 28, 28', connectors 29, 29', insulation guides 31, 31' insulating resilient internal roll bodies 33, 33', and set rings 34, 34'. The conductive outer surfaces of both rollers are connected through their brushes to their terminals 27, 27', as also shown in FIG. 2.

Figure 1:
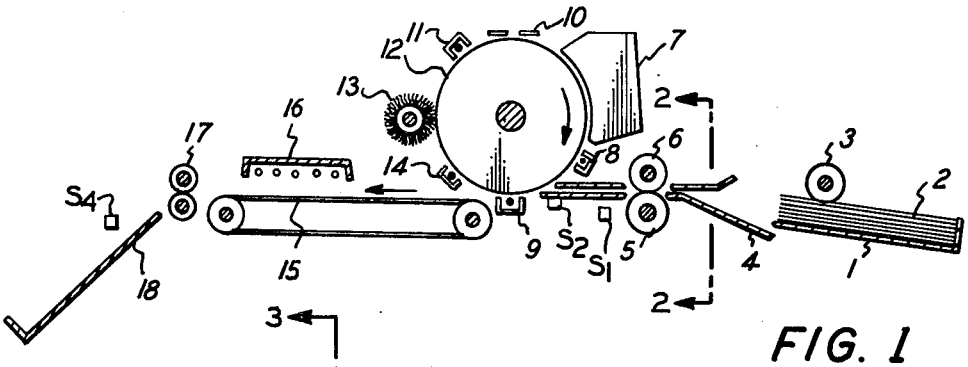
FIG. 1 is a schematic side view of an exemplary electrophotographic copying machine.
Figure 4:
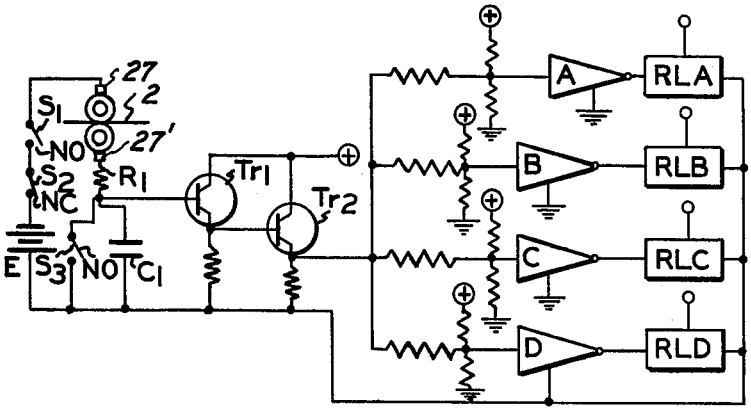
FIG. 4 is an electrical circuit diagram of a transfer control device connecting thereto.

During the passage of the paper sheet 2 between the sheet carrying rollers 5 and 6 and between the detection rollers 32 and 32', a first, normally open (NO) sheet detection switch $S_1$ there (see FIG. 1) detects the passage of the leading edge of paper sheet 2. It turns on (closes) and remains on during the passage of the paper sheet 2, to apply a predetermined voltage "E" to the sensor terminal 27, as shown in FIG. 4. Thus, in FIG. 3, electrical current flows through the route: terminal 27 to its connector 29 to carbon brush 30, to collector roller 32, through paper sheet 2, to collector roller 32', to carbon brush 30', to lead wire 29', to terminal 27'. Since the paper sheet 2 exhibits different resistance values depending on its moisture content, thickness, and material, the electrical current at terminal 27' varies accordingly. Since the paper sheet 2 generally used is generally standarized to a predetermined thickness and constituent materials, depending on the electrophotographic copying machine, the current flowing between the terminals 27–27' is thus normally in proportion to the moisture content.

As shown in FIG. 4, current flowing between terminals 27, 27' is stored in capacitor $C_1$ through current limiting resistor $R_1$ until the leading edge of paper sheet 2 further advances and arrives at a second, normally closed (NC) sheet detection switch $S_2$ (also shown in FIG. 1) which is opened during the passage of paper sheet 2. The voltage across capacitor $C_1$, therefore, represents a total value of integration which corresponds to an amount of moisture contained in the portion of the paper sheet that passes along the distance between first and second sheet detection switches $S_1$ and $S_2$.

This voltage stored across capacitor $C_1$ in FIG. 4 is amplified through transistors $Tr_1$ and $Tr_2$, and applied to the four differently biased threshold inputs of four drivers A, B, C and D comprising conventional operational amplifiers. When the paper sheet 2 is in a dried state (rank 1 in the above table), only driver A is operated by the amplified signal applied from the sensor, to excite only control relay RLA. When paper sheet 2 contains the optimum moisture content (rank 2 in the table), driver B is further operated to excite control relay RLB. When the paper sheet 2 contains a somewhat higher moisture content (rank 3 in the table), driver C is further operated to excite control relay RLC. When the paper sheet 2 contains an excessive moisture content (rank 4 in the table), driver D is operated also to excite control relay RLD.

Figure 5:
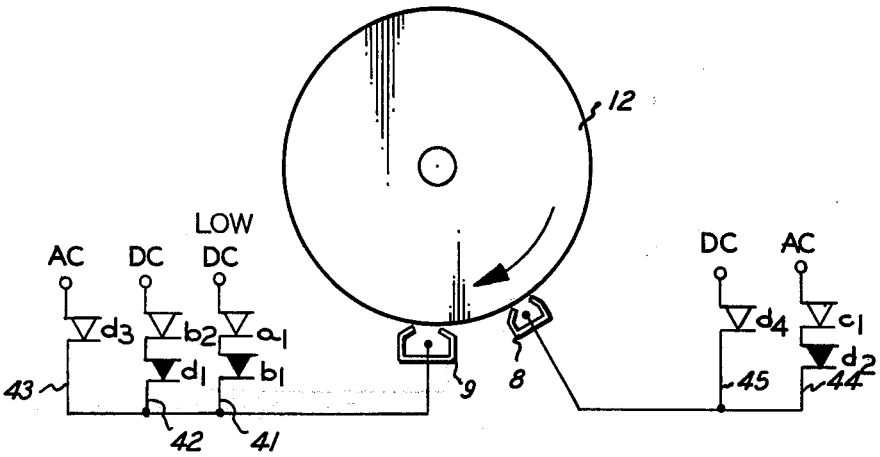
FIG. 5 is a control circuit diagram for the transfer corotrons of FIG. 1 as controlled by the circuit of FIG. 4, and the sensor of FIGS. 2 and 3.

In this manner, the four control relays RLA, RLB, RLC and RLD of FIG. 4 are actuatable in four steps depending on the humidity conditions of paper sheet 2 to apply optimum voltages to the transfer corotron 9 and/or the auxiliary transfer corotron 8 by switching their respective relay contacts, shown in FIG. 5, depending on the operation of each of the control relays.

Specifically, referring to FIG. 5, when paper sheet 2 is in a dried state, normally open contact $a_1$ of control relay RLA closes, causing line 41 to conduct thereby applying a relatively low DC voltage to transfer corotron 9. When the moisture content in paper sheet 2 is optimum, contact $b_1$of control relay RLB opens, rendering line 41 non-conductive, and contact $b_2$ of relay RLB closes, causing line 42 to conduct, thereby applying a normal DC voltage to transfer corotron 9. When the moisture content in paper sheet 2 is somewhat higher, contact $c_1$ of control relay RLC closes, causing line 44 to conduct, thereby applying an AC voltage to the auxiliary or pre-transfer corotron 8 while the normal DC voltage through line 42 is still being applied to transfer corotron 9. When the moisture content is excessively high, contacts $d_1$ and $d_2$ are opened by control relay RLD to render lines 42 and 44 non-conductive and, simultaneously, contacts $d_3$ and $d_4$ closed causing lines 43 and 45 to conduct, thereby applying an AC voltage to transfer corotron 9 and a DC voltage to the auxiliary transfer corotron 8, respectively.

Since self-maintaining (latching) type relays are employed for each of the control relays described above, these relays are not released after their actuation, i.e., even after the static charges stored in capacitor $C_1$ have been discharged by the actuation of a normally open cycle switch $S_3$ (FIG. 4) for a certain period in synchronism with sequential operations of the copying machine. Thus, the voltages supplied to each of the corotrons are kept constant. Transfer can, therefore, be equally done on the entire length of each of the paper sheets by a suitable transfer process which corresponds to the moisture contents in that sheet. As the paper sheet 2 is subsequently ejected after transfer, by sheet discharge roller 17 into a sheet output tray 18, an unlatching voltage pulse is thereby generated by a fourth sheet detection switch $S_4$ disposed in the vicinity of the sheet discharge roller 17. That unlatching pulse from switch $S_4$ is applied to each of the control relays, thereby releasing all of the control relays to stop the application of any voltages to the transfer corotron 9 and the auxiliary transfer corotron 8. Terminals are illuminated on the relays in FIG. 4 for this connection to switch $S_4$. Thus, the relays are returned to their initial state after transfer has been completed for each sheet. Switch $S_4$ may be located anywhere appropriate in the copy paper path downstream from the transfer station.

Where a continuous transfer is performed on a series of paper sheet, the sequential operations above-described are automatically repeated, so that a suitable individually adjusted transfer process is automatically taken for each paper sheet.

The switching between DC and AC described herein for the pre-transfer corotron may alternatively comprise switching between different DC bias levels on a constant or variable AC corotron supply voltage. In that case DC circuit switching may be addative or subtractive rather than substitutive.

The foregoing construction provides, in a transfer apparatus for electrophotographic copying machines in which imaging material is transferred to support media by a transfer corotron 9 and an auxiliary transfer corotron 8 for assisting transfer, a transfer control device comprising a measuring device for measuring moisture contents in the support media and a control circuit for switching voltages applied to the transfer corotron 9 and auxiliary transfer corotron 8 depending on the moisture contents.

In the present system the copy sheets do not have to be pre-heated. Thus, undesirable moisture effects on the optical system and on the photosensitive drum can be avoided as compared with electrophotographic copying machines in which better transfer of toner images to humid paper sheets is accomplished by pre-heating the paper sheets before transfer to obtain constant and lower moisture contents in the sheets. Yet, optimum transfer can be effected even with paper sheets in a fully dried state as well.

Various alternatives to the above structures will be apparent to those skilled in the art. For example, software controlled solid state digital logic circuitry may be used for the circuitry herein. Further, the switches $S_2$, $S_3$, and $S_4$, for example, may be replaced by time delay circuits generating corresponding switching signals at the end of appropriate time delays. The present claims are intended to encompass all such variations and modifications as fall within the spirit and scope of the invention.

What is claimed is:

1. In an electrostatographic copying system wherein an image on an initial image support is transferred to a second image support by variable transfer means, which transfer is affected by variations in the conductivity of the second image support, wherein said transfer means includes a transfer corona generator means to which a first voltage is applied for applying transfer charges to said second image support, and wherein said transfer means includes an auxiliary transfer corona generator means to which a second voltage is applied for applying pre-transfer charges to said initial image support, the improvement comprising:

conductivity sensing means for sensing the conductivity of the second image support prior to said transfer;

and transfer control circuit means controlled by said conductivity sensing means for varying both said first and second voltages applied to said transfer corona generator means and to said auxiliary transfer corona generator means in response to variations in the conductivity of the second image support sensed by said conductivity sensing means.

2. The electrostatographic copying system of claim 1, wherein said second image support is an individual copy sheet, and wherein said sensing means is adapted to measure the conductivity of said copy sheet for a predetermined substantial length thereof as said copy sheet is moved past said sensing means, and wherein said transfer control circuit means includes integration means for integrating the output of said sensing means over said predetermined length of the copy sheet to provide an averaged conductivity measurement for said copy sheet.

3. The electrostatographic copying system of claim 1, wherein said second image support is a copy sheet being moved toward said transfer means, wherein said conductivity sensing means comprises an opposing pair of overlying conductive rollers positioned upstream of said transfer means in the direction of the copy sheet movement toward said transfer means, wherein said conductive rollers are positioned to forcibly engage an intermediate portion of the copy sheet therebetween and roll along directly opposing areas of opposite sides of said copy sheet in pressure engagement therewith, said copying system further including current means for passing current between said opposing conductive rollers through the copy sheet engaged therebetween, and limiting means for limiting the period during which said current is passed through the copy sheet between said rollers to a pre-set period corresponding to a substantial predetermined length of the copy sheet being moved between said rollers towards said transfer means, and averaging means for averaging the current passed through said copy sheet between said rollers during said pre-set period to provide an averaged conductivity measurement of said pre-determined length of the copy sheet.

4. The electrostatographic copying system of claim 1, wherein said transfer control circuit means is connected to change at least one of said first and second applied voltages to said transfer corona generator means and said auxiliary transfer corona generator means from a direct current to an alternating current in response to a predetermined substantial change in conductivity of the second image support sensed by said conductivity sensing means.

5. The electrostatographic copying system of claim 4, wherein said transfer control circuit means is further connected to change at least one of said first and second applied voltages between at least two substantially different direct current voltage levels in response to a difference in conductivity of the copy sheet sensed by said conductivity sensing means.

6. The electrostatographic copying system of claim 1, wherein said transfer control circuit means is adapted to apply a said first applied voltage to said transfer corona generator means selected from an alternating current voltage and at least two different levels of direct current voltages, with said selection being controlled by said conductivity sensing means.

7. The electrostatographic copying system of claim 6, wherein said transfer control circuit means is additionally adapted to simultaneously apply a said second voltage to said auxiliary transfer corona generator selected from a direct current voltage and an alternating current voltage and no voltage.

8. The electrostatographic copying system of claim 1, wherein said transfer control circuit means comprises at least four selectively actuatable switching means actuated in response to at least four different levels of conductivity of said second image support sensed by said conductivity sensing means, and wherein said switching means connects with said transfer means to apply at least four different selected combinations of first and second applied voltages to said transfer means to compensate for the conductivity of said second image support.

9. The electrostatographic copying system of claim 8, wherein said first and second applied voltages include alternating current voltages and different levels of direct current voltages applied in response to different levels of conductivity sensed by said conductivity sensing means.

10. In an electrostatographic copying method wherein an image on an initial image support is transferred to a second image support by variable electrostatic transfer means, which transfer is affected by variations in the conductivity of the second image support, wherein said transfer means includes a transfer corona generator means to which first voltage is applied for applying transfer charges to said second image support, and wherein said transfer means further includes an auxiliary transfer corona generator means to which a second voltage is applied for applying pre-transfer charges to said initial image support, the improvement comprising:

sensing the conductivity of the second image support prior to said transfer; and varying both said first and second voltages applied to said transfer corona generator means and said auxiliary transfer corona generator means in response to variations in the conductivity of the second image support sensed by said conductivity sensing means to compensate for variations in the second image support.

11. The electrostatographic copying method of claim 10, wherein said second image support is an individual copy sheet, wherein the copy sheet is moved past said conductivity sensing means into said transfer means, and wherein the conductivity of the copy sheet is measured for a predetermined substantial length thereof as the copy sheet is moved past said sensing means, and wherein the output of said sensing means is integrated over said predetermined length of the copy sheet moved past said sensing means to provide an averaged conductivity measurement for said copy sheet.

12. The electrostatographic copying method of claim 10, wherein at least one of said first and second applied voltages to said transfer corona generator means and said auxiliary transfer corona generator means is changed from a direct current to an alternating current in response to a predetermined substantial change in conductivity of the second image support sensed by said conductivity sensing means.

13. The electrostatographic copying method of claim 12, wherein at least one of said first and second applied voltages is changed between at least two substantially different direct current voltage levels in response to a difference in conductivity of said second image support sensed by said conductivity sensing means.

* * * * *